United States Patent [19]

Canonico

[11] Patent Number: 4,749,997

[45] Date of Patent: Jun. 7, 1988

[54] MODULAR ANTENNA ARRAY

[75] Inventor: Lawrence M. Canonico, Smithtown, N.Y.

[73] Assignee: Grumman Aerospace Corporation, Bethpage, N.Y.

[21] Appl. No.: 890,829

[22] Filed: Jul. 25, 1986

[51] Int. Cl.[4] ..... H01Q 1/28

[52] U.S. Cl. ..... 343/705; 343/708; 343/872

[58] Field of Search ..... 343/705, 708, 793, 797, 343/810, 813, 814, 819, 820, 821, 827, 829, 846, 878, 879, 888, 893, 872

[56] References Cited

U.S. PATENT DOCUMENTS

| | | | |
|---|---|---|---|
| 2,470,016 | 5/1949 | Clapp | 343/817 |
| 2,562,296 | 7/1951 | Christensen et al. | 343/817 |
| 2,605,413 | 7/1952 | Alvarez | 343/815 |
| 2,799,018 | 7/1957 | Leitner et al. | 343/815 |
| 3,305,871 | 2/1967 | Kruger | 343/753 |
| 3,389,393 | 6/1968 | Young, Jr. | 343/708 |
| 3,829,862 | 8/1974 | Young | 343/767 |
| 4,186,400 | 1/1980 | Cermignani et al. | 343/817 |
| 4,336,543 | 6/1982 | Ganz et al. | 343/705 |
| 4,450,448 | 5/1984 | Albanese et al. | 343/379 |
| 4,514,734 | 4/1985 | Cermignani et al. | 343/708 |

FOREIGN PATENT DOCUMENTS 1261731 1/1972 United Kingdom .

*Primary Examiner*—William L. Sikes

*Assistant Examiner*—Hoanganh Le

*Attorney, Agent, or Firm*—Richard G. Geib; Daniel J. Tick; David Aker

[57] ABSTRACT

An antenna array which may be conformally mounted in an aircraft includes a plurality of non-parasitic antenna drivers. A conductive member serves as a ground plane and reflector. Each non-parasitic driver is coupled to an energy transformer, such as a receiver, by an energy conductor, such as a balun, which supports the element in spaced parallel relation with respect to the conductive member. The energy transformers are releasably secured to the conductive member, which preferably is formed of a plurality of portions, each portion having attached thereto a group of the energy transformers. The antenna array is formed by a series of modules including a portion of the conductive member with its attached energy transformers. The modules form a wing leading edge radome that is hinged to the aircraft along a longitudinal edge of the radome to permit easy access for servicing. The conductive member in each module has a slot for each driver to permit replacement of antenna driver/energy transformer assemblies. A non-conductive support tube in each module houses conductive directors and non-conductive spacers for positioning the directors with respect to the drivers. Alternatively, selected portions of the tube may be coated with a conductive material to serve as directors.

32 Claims, 3 Drawing Sheets

MODULAR ANTENNA ARRAY

BACKGROUND OF THE INVENTION

The present invention relates to modular antenna arrays. More particularly, the invention relates to modular conformal antenna arrays which may be mounted on the edge of a wing and may be used as passive or active/passive assemblies.

In the past, antennas suitable for airborne radar or electronic warfare applications were often mounted externally of the typical aerodynamic frame of an aircraft. Such structures had to be of relatively heavy construction to withstand the aerodynamic forces of flight. As a result of the relatively high weight and interaction with the air stream of such structures, overall aircraft weight and flight performance were compromised.

More recently, antenna systems have been conformally integrated into airframe structures. An example of an antenna with such a configuration is disclosed in U.S. Pat No. 4,336,543 for an "Electronically Scanned Aircraft Antenna System Having a Linear Array of Yagi Elements" issued to Ganz et al. and assigned to the assignee of the present invention. Ganz utilizes a plurality of endfire Yagi elements which may be positioned in the leading edge of a wing. A common reflector is used for the elements. Each element has a plurality of directors spacially located forward of the driver element.

Other antenna systems which may be conformally mounted are disclosed in U.S. Pat No. 4,186,400 for an "Aircraft Scanning Antenna System With InterElement Isolators" and U.S. Pat No. 4,514,734 for an "Array Antenna System with Low Coupling Elements," both issued to Cermignani and Ganz and also assigned to the assignee of the present invention.

While generally satisfactory, obtaining access to the array of Ganz et al. or Cermignani and Ganz, when mounted in the wing, for purposes of servicing, requires that the entire radome forming the leading edge of the wing be removed and the receivers or receiver/transmitter combinations that tie into the antenna drivers and are located in the wing box structure, be removed through access holes. In addition, once access has been obtained, it is relatively difficult to replace a single component which may be defective. Further these structures have considerable weight added due to the necessity of providing support structure for the many antenna elements in the array and related receivers or receiver/transmitter combinations and combiners. Finally, an extensive network of conductors is required to link the antennas located in the leading edge of the wing to the receiver or receiver/transmitter units located in the wing box structure.

The principal object of the invention is to provide an antenna array which is modular and which can be conformally integrated into an airframe structure.

Another object of the invention is to provide a modular antenna array wherein modules thereof include antenna/receiver or receiver/transmitter combination and combiner units.

An object of the invention is to provide an antenna array which may include related receiver or receiver/-transmitter combination and combiners and which can be mounted on an aircraft so as to permit easy access for servicing.

Another object of the invention is to provide an antenna array which may include related receiver or receiver/transmitter combinations and combiners and which can be conformally mounted in the edge of an aircraft wing.

Still another object of the invention is to provide an antenna array which may include related receiver or receiver/transmitter combinations and combiner assemblies, and which is of low weight.

Yet another object of the invention is to provide an antenna array which may include related receiver or receiver/transmitter combinations and combiners and which is mounted inside wing leading edge modules, that are hinged so as to swing away from the wing for access to the antenna components and interconnecting cables.

Another object of the invention is to provide an antenna array including related receiver or receiver/-transmitter combinations and combiners which requires relatively short length cables to interconnect the electronic system components.

Still another object of the invention is to provide an antenna array including related receiver or receiver/-transmitter combinations and combiners wherein components thereof can be easily replaced.

Yet another object of the invention is to provide an antenna array which may include related receiver or receiver/transmitter combinations and combiners, wherein a small number of structural elements are used to support the components of the array.

Still another object of the invention is to provide an antenna array wherein modules thereof can be individually tested.

Yet another object of the invention is to provide a structure for mounting the antenna driver/receiver or driver/receiver combination assemblies.

Still another object of the invention is to provide an antenna array and related receiver or receiver/transmitter combinations and combiners and which can be retrofitted onto existing aircraft with minimum impact on aircraft structure.

Yet another object of the invention is to provide an antenna array module wherein defective components thereof may be replaced in a modular fashion by personnel not requiring high levels of training or skill.

BRIEF SUMMARY OF THE INVENTION

In accordance with the invention, an antenna array comprises a plurality of colinear non-parasitic drivers. A conductive member serves as a ground plane for the array. Each antenna driver is coupled to an energy transforming means, such as a receiver or receiver/-transmitter combination which together define a non-parasitic assembly. The antenna members (parasitic and non-parasitic) are electrically spaced in parallel planes with respect to adjacent members and include at least one parasitic director for each antenna element. The antenna elements are arranged in modules wherein the number of antenna elements in a module (preferably four), defines the length of the module. The number of antenna elements per module is selected to provide a module size suited for ease of handling and servicing.

The antenna array is configured to be mounted within an aircraft radome. The radome may be formed as the edge of an aircraft wing and divided into sections consisting of one module each. The radome or the modular sections may be attached to the wing along one edge thereof by a hinge, thereby permitting pivoting with respect to the wing to allow access for servicing.

The conductive member (ground plane) may be configured with a slot for each antenna non-parasitic assembly, with the antenna driver portion of the assembly extending through the slot to be in position with respect to the parasitic directors. The slots and the antenna non-parasitic assembly are dimensioned so that the antenna driver can be passed through the slots from a first side of the conductive member to a second side of the conductive member opposite the first side. This arrangement provides ease of access for servicing the non-parasitic assembly.

According to a second aspect of the invention the antenna array comprises a plurality of radome sections (modules). Each section is configured as a portion of an exterior surface of an aircraft. The antenna non-parasitic and parasitic components that make up an antenna element are affixed to an interior surface of each radome section so that the radiation pattern of the antenna array extends away from the aircraft. Attachment means releasably secure the radome sections to the aircraft so that each radome section can be moved with respect to the aircraft to expose at least a number of the components of the antenna.

According to a third aspect of the present invention, the antenna array includes a non-conductive elongate member and a support means for supporting the elongate member in spaced parallel relation with respect to the antenna non-parasitic driver components. Conductors are affixed to the elongate member to act as directors for the antenna elements. The conductors may be rods spaced along the interior of the tube, positioned by non-conductive spacers, also located within the tube or the tube may be coated with an electrically conductive material in selected areas.

According to the invention, a plurality of combiners are used to combine signals within each module from the non-parasitic antenna assemblies. The modular configuration provides a geometric arrangement in which the close proximity of the receiver or receiver/transmitter combination to the combiners requires relatively short length interconnecting coaxial cabling.

BRIEF DESCRIPTION OF THE DRAWINGS

In order that the invention may be readily carried into effect, it will now be described with reference to the accompanying drawings, wherein.

DETAILED DESCRIPTION OF THE PREFERRED EMBODIMENT

Although the invention relates to antenna arrays generally, such as, for example, antenna arrays which are not mounted conformally and to antenna arrays which are suitable for transmitting and/or receiving, it is described herein with specific reference to a passive, adaptive array which can be conformally mounted in a leading edge of an aircraft wing.

Figure 1:
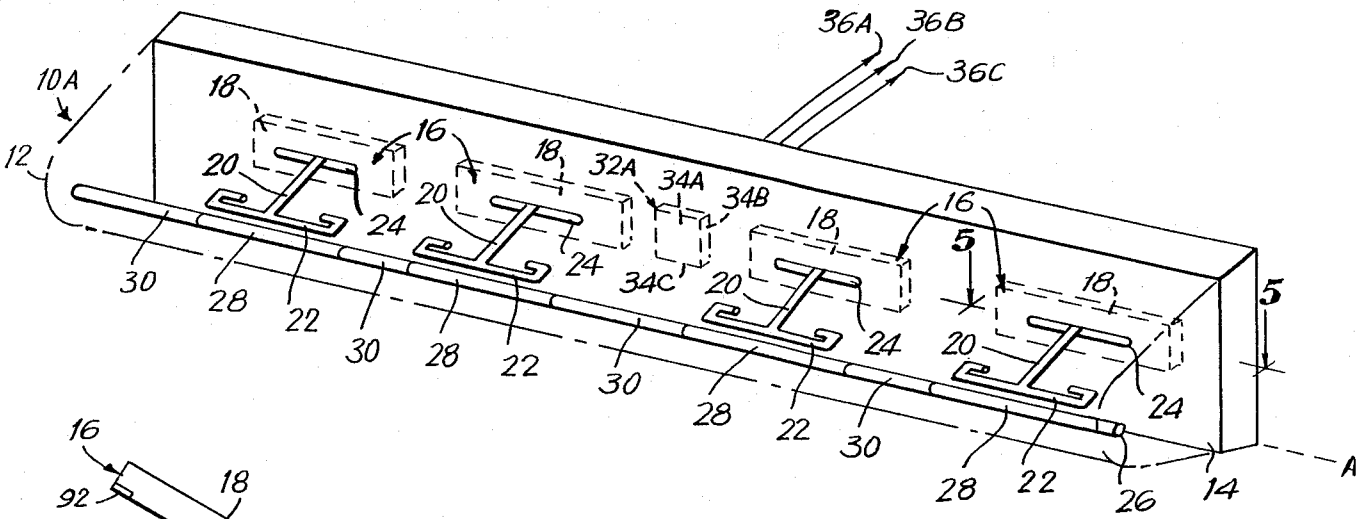
FIG. 1 is a conceptual, perspective view of an antenna array module according to the invention disposed in a wing leading edge radome.

Referring to FIG. 1, a module 10A according to the invention includes an antenna sub-array housed in a non-metallic structure or radome 12 which is shaped so as to serve as a part of the leading edge of a wing. Radome 12 is preferably constructed of skin stiffened ribs spaced along the length of radome 12 at intervals of approximately five inches. The spacing between ribs is determined in accordance with aircraft wing design loads. If the antenna array according to the invention is to be retrofitted on to an existing wing, the rib locations may be those utilized for the original metal wing leading edge structure. Specifically, radome 12 may be constructed of non-metallic material such as Kevlar 49/epoxy 181 woven cloth skins and rib members with S-Glass/epoxy tape added locally to provide additional strength at all rib locations and areas having bolted joints. Leading edge skins and ribs may be integrally cured. It will be understood that, alternatively, a typical radome sandwich construction may be used for radome 12. Weight is a primary consideration in any design.

A ground plane 14 is formed of a planar metallic member, such as sheet aluminum, affixed within radome 12. The exact manner of affixing ground plane 14 within radome 12 is described more fully with reference to FIG. 3.

Four antenna driver/receiver assemblies shown generally as 16 are affixed to ground plane 14. Antenna driver/receiver assemblies 16 each include a receiver 18 and a non-parasitic driver 22 supported forward of each receiver 18. Drivers 22 are of the type disclosed in above mentioned U.S. Pat. No. 4,514,734 to Cermagnani et al and are "hooked" dipoles with inwardly facing tips. It will be understood that the term "driver" refers to the "driven" or non-parasitic dipole of a Yagi element of an antenna array rather than the parasitic reflector or directors. This term is used whether the array is designed as a passive array and therefore only for receiving, or for transmitting and receiving. In other words, driver 22 is not a reflector or a director, but a primary operating element connected to receiver 18 so that electromagnetic energy of appropriate frequency received by driver 22 is transmitted to receiver 18, or if the array were also being used as a transmitter, each driver 22 would be a driven element receiving power from a receiver/transmitter module. Drivers 22 are supported by and interconnected directly to their respective receivers 18 (or, receiver/transmitted combinations) by respective baluns 20 (of the type also disclosed in U.S. Pat. No. 4,514,734) eliminating the need for separate wire connections. Drivers 22 are parallel to ground plane 14 and preferably arranged so as to be colinear.

Ground plane 14 has cut out portions in the form of slots 24 each sufficiently large for a respective driver 22 to fit through, thus facilitating replacement of an antenna driver/receiver assembly 16 including receiver 18, and its associated balun 20 and driver 22 as a unit, as more fully described below.

A non-metallic director support tube 26 is also affixed within radome 12 in a direction parallel to the longitudinal axis thereof and therefore parallel to ground plane 14 and drivers 22. A conductive rod, or for purposes of weight reduction, a thin walled tube 28, is placed within tube 26 opposite each driver 22 to serve as a director. A series of non-conductive spacers 30 are also placed within tube 26 to prevent motion of tubes 28 away from their respective proper positions for acting as directors for drivers 22. Directors may also be provided by applying a conductive coating to tube 26 at selected locations (opposite drivers 22) on the interior or exterior surface thereof.

It will be understood that the combination of ground plane 14, a driver 22 and a director 28 form an antenna element. Above mentioned U.S. Pat. No. 4,514,734 specifies the spacing between the directors 28 and their respective drivers and the spacing between drivers 22 and ground plane 14. The latter spacing may be varied somewhat by an adjustment of the position of drivers 22 along the lengths of respective baluns 20. Ground plane 14 acts as a reflector for drivers 22.

Module 10A preferably contains an even number of such simple antenna elements which are designed to provide some degree of directivity over a relatively broad frequency range so that module 10A acts as a relatively broad band passive receiving device. However, if it is desirable for module 10A to be a component of an array which is used for transmitting, radome 12 may be enlarged to provide space for additional tubes (not shown) parallel to tube 26 to support addition directors (not shown) in a manner similar to that of tube 26. Such additional directors produce a more sharply directed beam. However, the resulting array will be useful over a narrower frequency range. It will be understood that for radar transmitting applications, receivers 18 would be replaced by appropriate devices for coupling energy for transmission by drivers 22.

The receive signals conducted from drivers 22 are processed by receivers 18. The outputs of receivers 18 are combined in a signal combiner 32 having three combiner sections 34A, 34B and 34C. More specifically, each receiver 18 has three signal outputs which are coupled to sections 34A, 34B and 34C, respectively. Thus, each section 34A, 34B and 34C has four inputs; that is one corresponding output from each of receivers 18. A total of twelve cables (not shown) are therefore used to connect the outputs of receivers 18 to respective sections of combiner 32. These twelve cables are all of identical electrical characteristics, including identical phase delay so that the signal presented at the inputs of combiner sections 34A, 34B and 34C all undergo identical phase delays during propagation along the cables from receivers 18 to combiner sections 34A, 34B and 34C.

The outputs of combiner sections 34A, 34B and 34C are connected to cables 36A, 36B and 36C respectively, which carry the signals for appropriate processing to an electronic system located in the fuselage.

Combiner 32 may be any one of several commercially available devices, modified in accordance with particular specifications, in a manner well known in the art.

Figure 2:
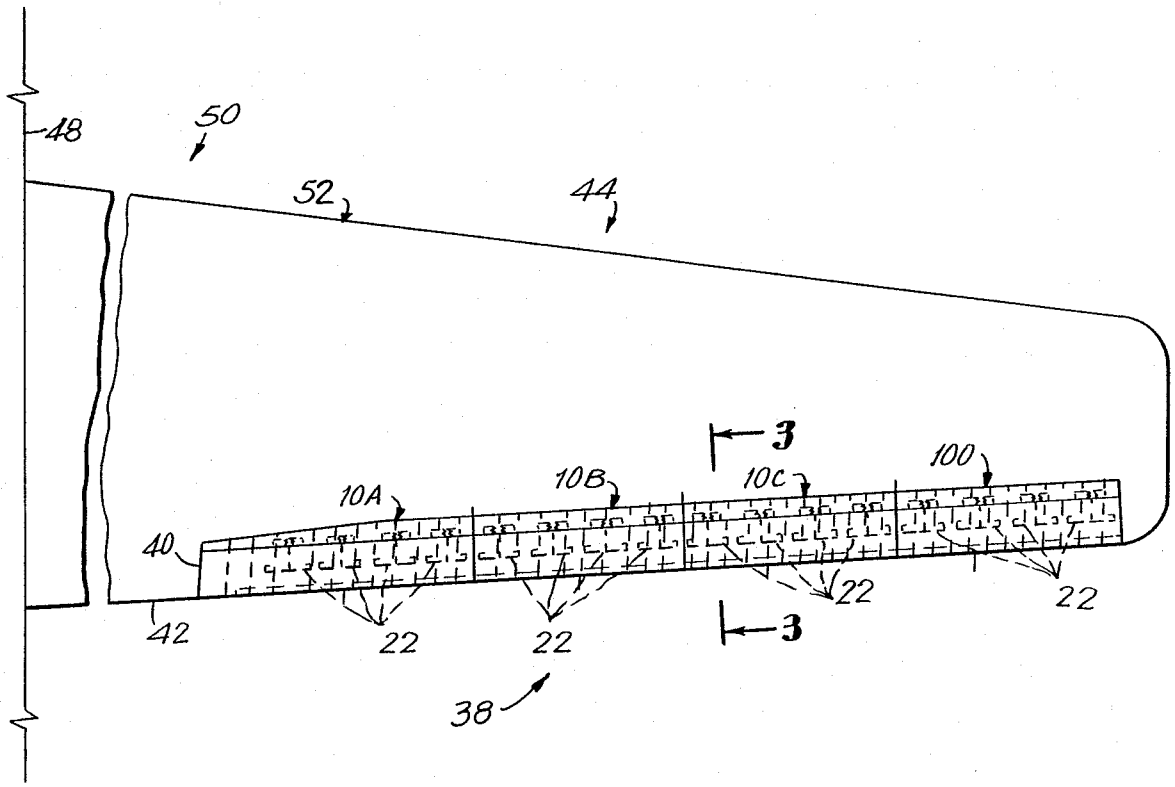
FIG. 2 is a conceptual, plan view of an aircraft including a plurality of modules according to FIG. 1 mounted in the leading edge of an aircraft wing.

Referring to FIG. 2, an antenna array 38 is formed of four modules 10A, 10B, 10C and 10D according to the invention which are received in a recess 40 in the leading edge 42 of an aircraft wing 44. Each module 10A, 10B, 10C and 10D is connected by respective cables (not shown) to the electronics package located in the fuselage 48 of the aircraft 50.

The electronics package will generally include steering circuitry of a type well known in the art, which is used to change at least one of the relative phase and amplitude of signals appearing on the cables providing input signals thereto. As is well known in the art, such changes in relative phase and/or amplitude effectively "steer" the direction of maximum sensitivity of the antenna array by changing these relationships with respect to the groups of drivers 22 in modules 10A, 10B, 10C and 10D.

It will be understood that the other wing (not shown) will generally contain an antenna array identical to antenna array 38. While array 38 is mounted in leading edge 42, it could also be mounted in trailing edge 52 of wing 44 or at other locations on the outer surface of aircraft 50.

Recess 40 is shaped so that modules 10A, 10B, 10C and 10D are received therein with ground planes 14 of all modules disposed in a single plane, and with longitudinal edges thereof along a single line. The conformal design of array 38, which is a result of the shaping of the radomes so as to serve as parts of the leading edge of a wing, serves to make array 38 ideal for installation on new aircraft or for retrofit on existing aircraft when substituted for existing leading edge components. It will be understood that to the extent the shape and weight of the wing is altered by replacing leading edge components with radomes according to the invention, the aerodynamics of the wing will be altered, and that appropriate analysis and flight testing will be required to assure that aircraft performance requirements continue to be met. However, the impact on performance is minimal when compared to that resulting from the utilization of a structure such as a large dome mounted on the fuselage of an aircraft.

Figure 3:
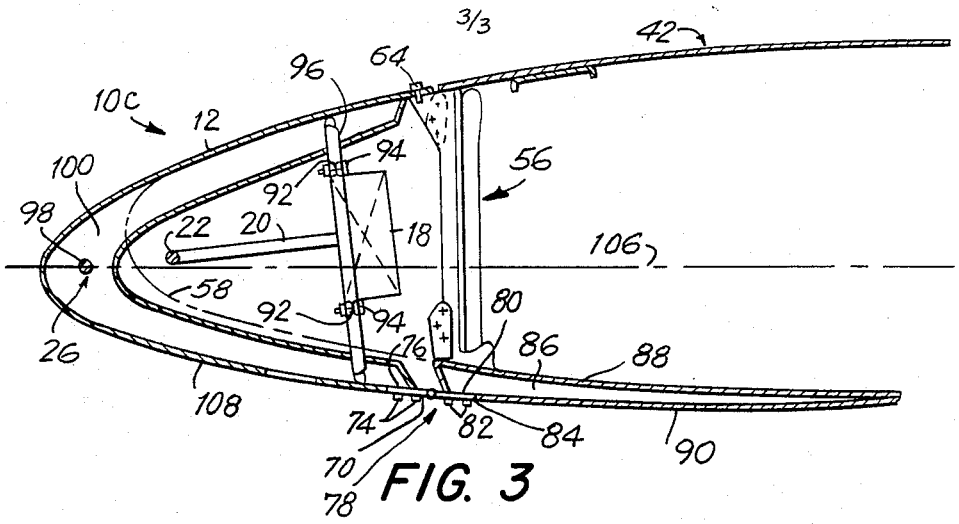
FIG. 3 is a cross-sectional view taken along line 3—3 of FIG. 2.
Figure 4:
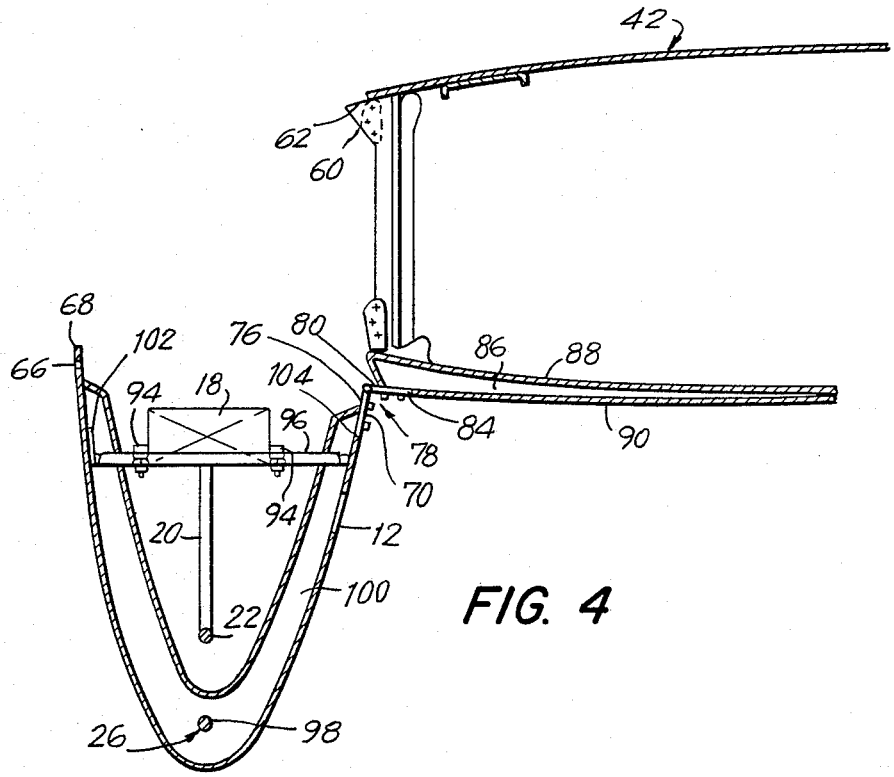
FIG. 4 is similar to FIG. 3, but illustrates the radome in an open position.

Referring to FIG. 3 and FIG. 4, module 10C is shown in cross section, attached to wing 44 at the front beam 56. In retrofit applications, it may be necessary to extend the new leading edge forward of the prior leading edge 58 defined by prior leading edge components (not shown). An extension of the existing wing contour may be developed.

The new airfoil sections are preferably variants of the existing sections with the upper surface of the new sections tangent to the old section at the front beam. This achieves the objective of permitting utilization of the existing wing leading edge attachment structure as the attachment structure for radomes 12, according to the present invention.

The new wing structure in a retrofit application is preferably designed to maintain the same load paths for the leading edge loads as in the prior configuration. These loads are generally introduced into the box beams of the wing as shears and chordwise bending moments at front beam 56. Segmenting of the new leading edge into four modules 10A, 10B, 10C and 10D minimizes the introduction of spanwise load, due to bending of wing 44 into the new leading edge, and facilitates servicing, as more fully described below. In particular, an upper attachment structure 60 associated with front beam 56 has a planar surface 62 for receiving a series of fasteners 64 extending through a series of holes in an upper attachment portion 66 of radome 12.

A second attachment portion 70 of radome 12 is configured with a series of holes extending along a line parallel to the lower edge 72 of radome 12. These holes receive a series of fasteners 74 which serve to secure second attachment portion 70 of radome 12 to a first planar portion 76 of a hinge 78. A second planar portion 80 of hinge 78 is connected by a series of fasteners 82 to a planar portion 84 of a fairing support 86 attached to the original lower surface 88 of wing 44. Fairing support 86 provides attachment for radome 12, as well as for a fairing 90 which completes the modified airfoil shape and preserves a smooth lower surface. Since the shape of aft portions of the wing is maintained, the original high lift characteristics are not changed.

The receivers 18 have mounting tabs 92 to facilitate mounting to ground plane 14 with fasteners 94. A ground plane stiffener 96 is provided at each vertical side of each receiver 18. Stiffeners 96 each have "L" shaped cross sections including a first planar portion in contact with ground plane 14 and secured thereto by a series of fasteners (not shown) and a second planar portion extending perpendicularly with respect to both ground plane 14 and the longitudinal axis of radome 12. Stiffeners 96, in addition to supporting the receivers, serve to increase the strength of ground plane 14 with only a slight increase in the weight thereof.

Director support tube 26 extends through holes 98, on colinear centers, in ribs 100 of radome 12, thus securing tube 26 in place within radome 12.

Ground plane 14 has an upper flange 102 and a lower flange 104 which are in contact with the internal surface of radome 12 and are secured thereto, respectively, by an upper series of fasteners (not shown) and a lower series of fasteners (not shown) which pass through holes (not shown) in radome 12 provided along a line parallel to upper edge 68 and lower edge 72, respectively, of radome 12. The angle and the positioning of the antenna elements are selected to compliment the contour of the wing so that the antenna array 38 is angled at a downward slope with respect to the wing reference plane 106. This serves to align the array, in the pitch direction, with the flight path of the aircraft, by compensating for the aircraft angle of attack with respect to the fuselage reference line (not shown) during a search mode when antenna array 38 is in use, and the wing angle of incidence with respect to the fuselage reference line.

Removal of an antenna driver/receiver assembly 16, including receiver 18 and its associated driver 22 for servicing is accomplished by first determining which array module or modules 10A, 10B, 10C and 10D have defective components. A built-in test system may be provided for this purpose.

Once it has been determined that a module 10A, 10B, 10C and 10D has a defective component, the fasteners 64 securing upper attachment portion 66 of the radome to planar surface 62 of upper attachment structure 60 are removed. As soon as the last fastener 64 is removed, the module is allowed to swing from the closed position shown in FIG. 3, to the open position shown in FIG. 4, thus providing access to the portion of radome 12 behind receivers 18. The wires (not shown) that interconnect the receiver 18 to the rest of the system, including those providing power and those cables connecting the receiver 18 to the sections of the combiner are disconnected from receiver 18. The fasteners 94 securing receiver 18 to ground plane 14 are then removed.

Figure 5:
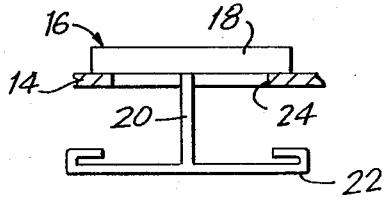
FIG. 5 is a partial cross sectional view taken, generally, along line 5—5 of FIG. 1.
Figure 6:
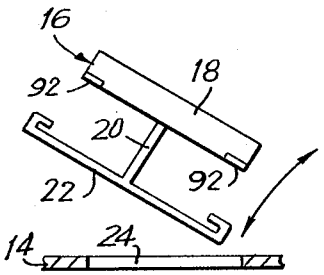
FIG. 6 is a view similar to FIG. 5, showing the manner in which a receiver-antenna assembly is inserted into and removed from the array module.

As shown in FIG. 5 and FIG. 6, once fasteners 94 have been removed, receiver 18, balun 20 and driver 22 may be removed from ground plane 14 by simply manipulating antenna driver/receiver assembly 16 so that driver 22 is withdrawn through slot 24. Slot 24 is dimensioned to permit such withdrawal.

After antenna driver/receiver assembly 16, including receiver 18, balun 20 and driver 22 has been repaired, antenna driver/receiver assembly 16 may be reinstalled by reversing the procedure set forth above. Alternatively, a defective antenna driver/receiver assembly 16 may simply be replaced by an identical assembly known to be in operating condition, and the assembly 16 that has been removed can be repaired at another time and/or location as may be convenient. Thus, a module 10A, 10B, 10C or 10D may be repaired by replacing a component with only minimal effort by service personnel who do not have to be highly trained.

Each array module 10A, 10B, 10C and 10D may be removed from the wing 44 for bench testing, with antenna driver/receiver assemblies 16 installed, by placing the module in the open position illustrated in FIG. 4, disconnecting the appropriate cables from the combiner to an electronic package wiring interface (not shown) in the wing and removing fasteners 82, thereby separating the module 10A, 10B, 10C or 10D from wing 44. Removing the pin (wire) of hinge 78 is an alternate method for removing the modules.

When a module 10A, 10B, 10C and 10D is removed from wing 44, or in the open position illustrated in FIG. 4, directors 28 and spacers 30 may be removed by removing tube 26 and if necessary, serviced or replaced. Since the directors are parasitic, there are no wire connections thereto, and only infrequent cause for removal.

Referring again to FIG. 3 and FIG. 4, an inflatable deicing boot 108 is provided exterior of radome 12. Boot 108 is formed of a non-conductive material such as a rubber or a polyurathane.

Each module 10A, 10B, 10C and 10D is configured with a separate deicing boot 108 which is connected to a source of compressed air (not shown) on aircraft 50, by air supply lines and fittings (not shown) that are nonconductive at any position forward of ground plane 14. A disconnect for the air supply for each module 10A, 10B, 10C and 10D is provided to facilitate removal from the wing 44.

Various modifications of the invention will be apparent to those skilled in the art. For example, the antenna array of the present invention may be installed in a fuselage mounted strake such as those found on certain aircraft.

It will also be apparent to those skilled in the art, after reading the specification, that the present invention, by locating the receiver or receiver/transmitter combinations in the radome, rather than in the wing, makes it possible to minimize the number of access openings for electronic components that must be provided in the wing, thus simplifying the construction and not compromising the strength of a new wing and facilitating installation in retrofit applications.

Although shown and described in what is believed to be the most practical and preferred embodiment, it is apparent that departures from the specific design described and shown will suggest themselves to those skilled in the art and may be made without departing from the spirit and scope of the invention. I, therefore, do not wish to restrict myself to the particular construction described and illustrated, but desire to avail myself of all modifications that may fall within the scope of the appended claims.

What is claimed is:

1. An antenna array comprising:

a plurality of colinear non-parasitic antenna drivers;

a conductive member serving as a ground plane for the array, said conductive member being configured with a respective slot for each said driver, said antenna drivers and said slots being dimensioned so that said antenna drivers can be passed through said slots from a first side of said conductive member, to a second side of said conductive member opposite said first side, and a respective support and energy conductor means for each said antenna driver for supporting said driver in spaced apart parallel relation with respect to said conductive member and for providing electromagnetic coupling to said driver.

2. The antenna array of claim 1, further comprising: a respective director for each said antenna driver; and a director support means for supporting said respective directors in spaced parallel relation with respect to said antenna drivers.

3. The antenna array of claim 1, further comprising a respective energy conversion means for each said antenna driver; and means for releasably securing said energy conversion means to said conductive member.

4. An antenna array comprising:

a plurality of radome portions configured as adjacent parts of an exterior surface of an aircraft;

a respective antenna sub-array having portions thereof affixed to an interior surface of each said radome portion so that a radiation pattern of said sub-array extends away from said aircraft; and attachment means for releasably securing said radome portions to said aircraft so that each said radome portion may be moved with respect to said aircraft to expose at least a part of said sub-array.

5. The antenna array module of claim 4, wherein said radome portions are configured as at least a part of an edge of a wing of said aircraft.

6. The antenna array of claim 4, wherein said attachment means includes a hinge means for securing a first longitudinal edge of each radome portion to a first portion of said aircraft, and securing means for securing a second radome portion longitudinal edge of each radome to a second portion of said aircraft so that upon release of said securing means said radome portions may pivot about said hinge means with respect to said aircraft.

7. The antenna array of claim 4, wherein each said sub-array comprises:

a conductive member mounted to an interior surface of said radome portion, said conductive member serving as a ground plane for said sub-array;

a plurality of non-parasitic antenna drivers disposed on a first side of said conductive member intermediate said conductive member and said exterior surface;

a respective energy conversion means coupled to each said antenna driver for converting energy for each said antenna driver, said energy conversion means being disposed on a second side of said conductive member opposite said first side; and releasable securing means for releasably securing said respective energy conversion means to said conductive member;

whereby said energy conversion means are exposed for removal from said radome portion when an edge of said radome portion is moved from said aircraft.

8. The antenna array of claim 4, wherein each said sub-array comprises a plurality of colinear non-parasitic antenna drivers, a respective energy conversion means for converting energy for each said driver, and a respective support and energy conductor means for each said driver for supporting said driver with respect to said energy conversion means and for conducting energy between said driver and said energy conversion means, and releasable securing means for releasably securing said driver, said respective energy conversion means, and said respective support and energy conductor means as a unit in said sub-array.

9. The antenna array of claim 8, wherein said releasable securing means secures said respective energy conversion means within said sub-array.

10. An antenna array comprising:

a plurality of colinear non-parasitic antenna drivers:

a conductive member serving as a ground plane for the array;

a respective energy transforming means for each said driver;

securing means for releasably securing each said respective energy transforming means to said conductive member; and a respective support and energy conductor means for each said driver for supporting said driver in spaced parallel relation with respect to said conductive member and for providing electromagnetic coupling to said driver, each said respective support and energy conductor means extending from one said driver to one said energy transforming means.

11. The antenna array of claim 10, wherein said conductive member comprises a plurality of portions, each portion having attached thereto a selected number of respective energy transforming means.

12. The antenna array of claim 11, wherein said portions of said conductive member are coplanar.

13. The antenna array of claim 10, in combination with a radome formed as an edge member of an aircraft wing, said antenna array being mounted with respect to said radome so that a pattern of said array extends away from said wing.

14. The antenna array of claim 13, wherein said array is mounted so that said pattern is aligned in a direction of a flight path of an aircraft of which said wing is a part when said radome is attached to said wing.

15. The antenna array of claim 13, mounted interior of said radome.

16. The antenna array of claim 13, further comprising attachment means for securing said radome to said wing.

17. The antenna array of claim 16, wherein said attachment means includes a hinge means for securing a first longitudinal edge of said radome to a first portion of said wing, and securing means for securing a second longitudinal edge of said radome to a second portion of said wing, so that upon release of said securing means said radome may pivot about said hinge means with respect to said wing to permit access to said antenna array.

18. The antenna array of claim 17, wherein said conductive member is configured with a respective slot for each said driver, said respective support and energy conductor means extending through said slot to said energy transforming means.

19. The antenna array of claim 18, wherein said slots and said drivers are dimensioned so that said drivers can be passed through said slots from a first side of said conductive member, to a second side of said conductive member opposite said first side.

20. The antenna array of claim 10, wherein said respective first support and energy conductor means support said drivers at a distance from said conductive member, so that said conductive member acts as a reflector for said drivers.

21. The antenna array of claim 10, wherein said conductive member is configured with a respective slot for each said driver, said respective support and energy conductor means extending through said slot so that said drivers are on a first side of said conductive member and said energy transforming means are on a second side of said conductive member opposite said first side.

22. The antenna array of claim 21, wherein said slots, and said drivers are dimensioned so that said drivers can be passed through said slots from said first side of said conductive member, to said second side of said conductive member.

23. The antenna array of claim 10, wherein said energy transforming means are one of radar receivers and receiver/transmitter combinations.

24. The antenna array of claim 10, wherein said energy transforming means are radar receivers, further comprising a plurality of combining means for combining the signals from selected groups of said radar receivers.

25. The antenna array of claim 10, further comprising:

a respective director element for each said antenna element; and a director support means for supporting said respective directors in spaced parallel relation with respect to said antenna elements.

26. The antenna array of claim 25, further comprising a radome for covering said antenna array, wherein said director support means supports said directors so that said directors are positioned within said radome to be free of contact with said radome.

27. An antenna array comprising:

a plurality of colinear non-parasitic antenna drivers;

a reflector means for said drivers supported in spaced apart parallel relation with respect to said drivers;

electromagnetic coupling means for providing electromagnetic coupling to said drivers;

a non-conductive elongate tubular member;

a support means for supporting said elongate tubular member in spaced parallel relation with respect to said antenna drivers; and a respective parasitic conductor positioned with respect to said elongate tubular member for each said antenna driver, each said conductor being a director for one said antenna driver.

28. The antenna array of claim 27, wherein said respective conductors are rods spaced along and interior of said tubular member.

29. The antenna array of claim 28, further comprising non-conductive spacing means interior of said tube for positioning said rods along said tubular member.

30. The antenna array of claim 27, wherein each said respective conductor comprises a conductive coating applied to selected portions of a surface of said tubular member.

31. The antenna array of claim 27, further comprising a radome for covering said antenna array.

32. The antenna array of claim 31, wherein said support means supports said elongate tubular member so that said elongate tubular member is positioned within said radome to be free of contact with said radome.

* * * * *